US006958115B2

(12) United States Patent
O'Gardy et al.

(10) Patent No.: US 6,958,115 B2
(45) Date of Patent: Oct. 25, 2005

(54) LOW TEMPERATURE REFINING AND FORMATION OF REFRACTORY METALS

(75) Inventors: William E. O'Gardy, Hyattsville, MD (US); Graham T. Cheeck, Annapolis, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/602,056

(22) Filed: Jun. 24, 2003

(65) Prior Publication Data

US 2004/0262166 A1 Dec. 30, 2004

(51) Int. Cl.[7] ..... C25C 1/00

(52) U.S. Cl. ..... 205/367; 205/368; 205/371; 205/397; 205/398; 205/402; 205/406; 205/410; 205/560; 205/564; 205/572

(58) Field of Search ..... 205/367, 368, 205/371, 397, 398, 402, 406, 410, 560, 564, 205/572

(56) References Cited

U.S. PATENT DOCUMENTS 6,368,486 B1 * 4/2002 Thompson et al. ..... 205/406

6,527,938 B2 * 3/2003 Bales et al. ..... 205/229

OTHER PUBLICATIONS

Fray et al, Removal of Oxygen from Metal Oxides and Solid Solutions by Electrons in a Fused Salt, PCT Application GB99/01781.

Mamantov et al, "Chemistry of Nonaqueous Solutions Current Progress", VCH Publishers, Inc., 1994, pp. 227-275, The United States of America, no month.

Chen et al, "Direct Electrochemical Reduction of Titanium in Molten Calcium Chloride", Macmillan Magazines Ltd, Sep. 21, 2002, pp. 361-364, vol. 407, United Kingdom.

Ngo et al, "Thermal Properties of Imidazolium Ionic Liquids", Elsevier Science B.V., 2000, pp. 97-102, The United States of America, no month.

Chauvin et al, "Nonaqueous Ionic Liquids as Reaction Solvents", American Chemical Society, 1995, pp. 26-30, The United States of America, no month.

* cited by examiner

*Primary Examiner*—Arun S. Phasge
(74) *Attorney, Agent, or Firm*—John J. Karasek; George A. Kap

(57) ABSTRACT

This invention discloses and claims the low temperature reduction and purification of refractory metals, metal compounds, and semi-metals. The reduction is accomplished using non-aqueous ionic solvents in an electrochemical cell with the metal entity to be reduced. Using this invention, $TiO_2$ is reduced directly to Ti metal at room temperature.

10 Claims, 4 Drawing Sheets

LOW TEMPERATURE REFINING AND FORMATION OF REFRACTORY METALS

FIELD OF THE INVENTION

Figure 1:
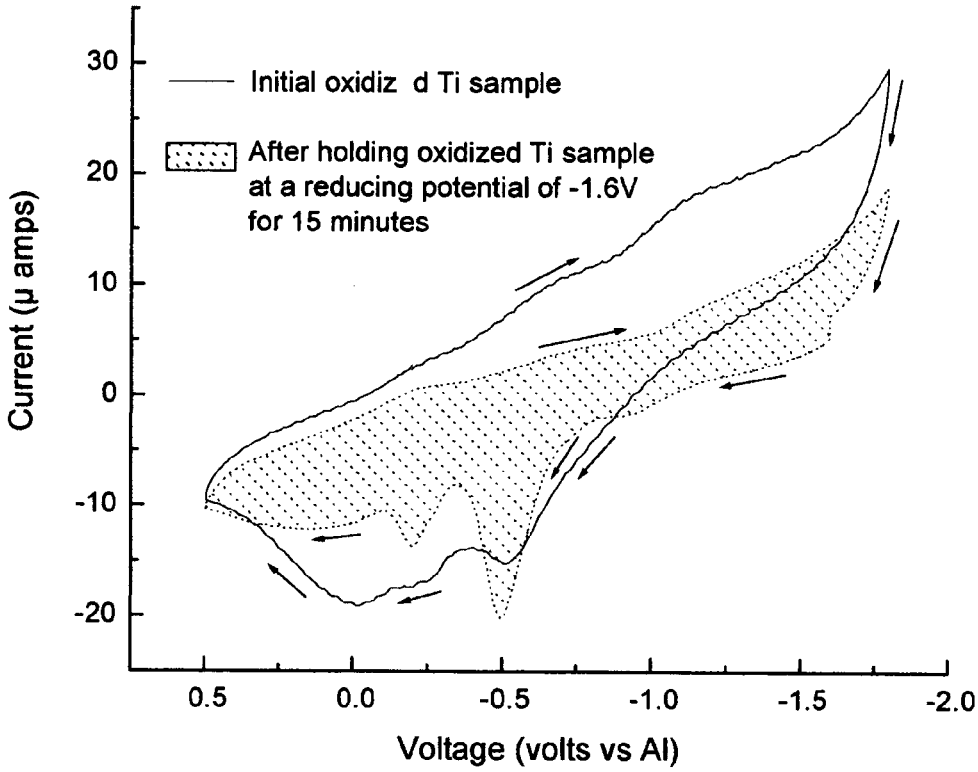

This invention pertains to electrochemical reduction and purification of refractory metals, metal compounds and semi-metals at low temperatures in non-aqueous ionic solvents. Metals and semi-metals form oxides and they also have a significant oxygen solubility. Using the methods described herein below it is possible to produce metals such as titanium from bulk titanium dioxide at significant cost savings. Further, it is possible to reduce or remove the oxides on highly oxidized titanium metal surfaces.

BACKGROUND OF THE INVENTION

The Kroll process and Hunter process are methods currently in use for the production of titanium metal from titanium dioxide. In these methods, $TiO_2$ is reacted with chlorine gas to produce titanium tetrachloride, a volatile corrosive liquid. This is reduced to titanium metal by reacting with metallic magnesium in the Kroll process or with sodium in the Hunter process. Both processes are carried out at high temperatures in sealed reactors. Following this, a two-step refining process is carried out which includes two high temperature vacuum distillations to remove the alkali metal and its chloride from titanium metal.

The refining of titanium by electrochemical means has long been a sought after process. It has been shown in the literature that oxygen could be removed from titanium and titanium alloys using an electrochemical high temperature molten salt method. This has led to the development of a possible new method of extracting and refining titanium directly from the oxide ore and was published by G. Z. Chen, D. J. Fray and T. W. Farthing in Nature 407, 361 (2002), and PCT international application publication number WO 99/64638, 16 Dec. 1999. Both documents are incorporated herein by reference in their entirety. This process involves electrochemistry in a high temperature molten salt, molten $CaCl_2$ at ~800 C. In these publications two different mechanisms are proposed for the reduction of titanium oxides. In the first mechanism it is proposed that the $Ca^{+2}$ ions are reduced to metallic Ca at the cathode. Then the Ca metal chemically reacts with the $TiO_x$ forming an oxygenated Ca species, CaO, which is soluble in the melt forming $Ca^{+2}$ and $O^{-2}$. The second mechanism proposed was the direct electrochemical reduction of the $TiO_x$ to Ti metal and an oxygen species such as $O^{-2}$. This is followed by the migration of the $O^{-2}$ to the carbon anode where it forms a volatile species such as CO or $CO_2$.

BRIEF SUMMARY OF THE INVENTION

We have established that a refractory metal oxide can be electrochemically reduced directly to the metal at room temperature. In this, $TiO_2$ was immersed in a non-aqueous ionic solvent in an electrochemical cell in which a highly oxidized titanium strip is the cathode, a Pt wire the anode, and an Al wire was used as a reference electrode. After determining a voltage at which $TiO_2$ could be converted to Ti metal, a current was passed through the electrochemical system at the determined voltage to produce Ti metal.

DRAWINGS

FIG. 1. shows the voltage window for the production of Ti from $TiO_2$ in a non-aqueous ionized solvent.

Figure 2:
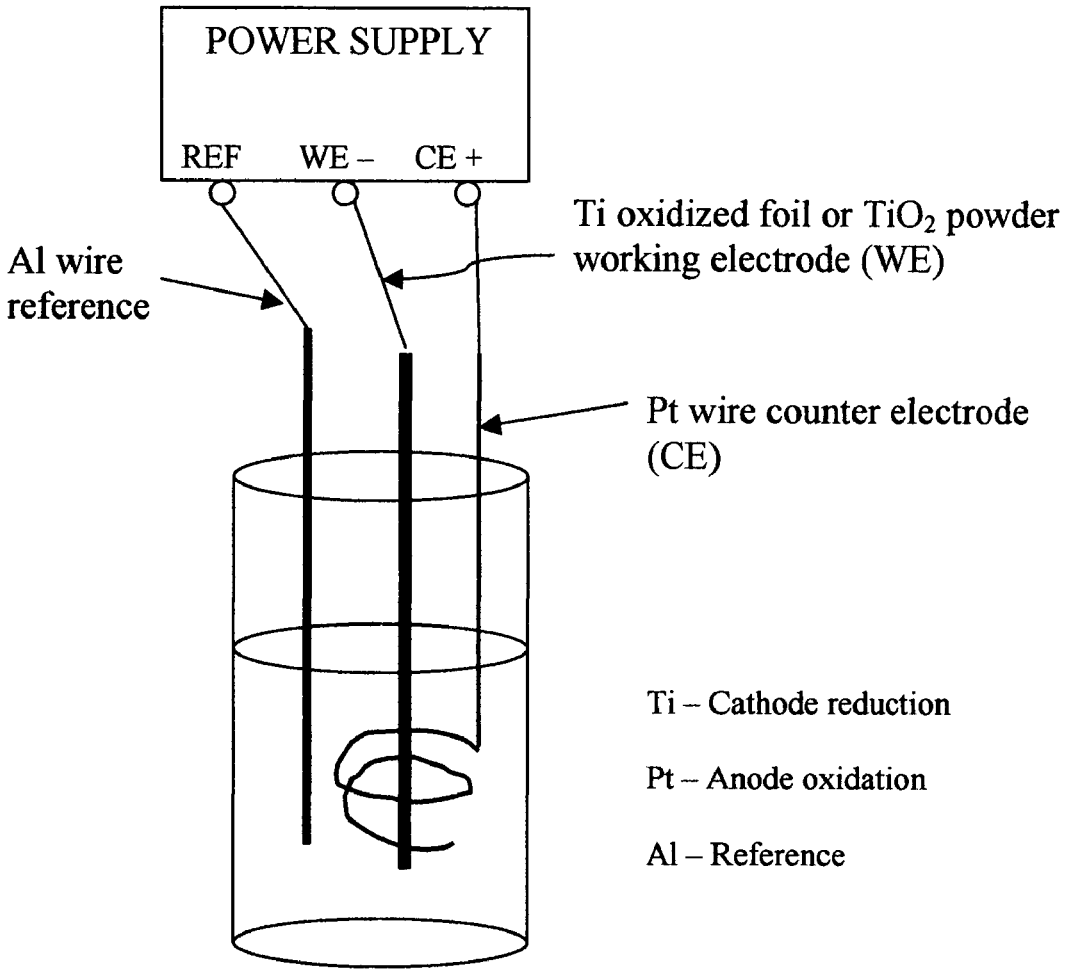

FIG. 2. shows the apparatus used to demonstrate the invention and produce the results shown in FIG. 1.

Figure 3:
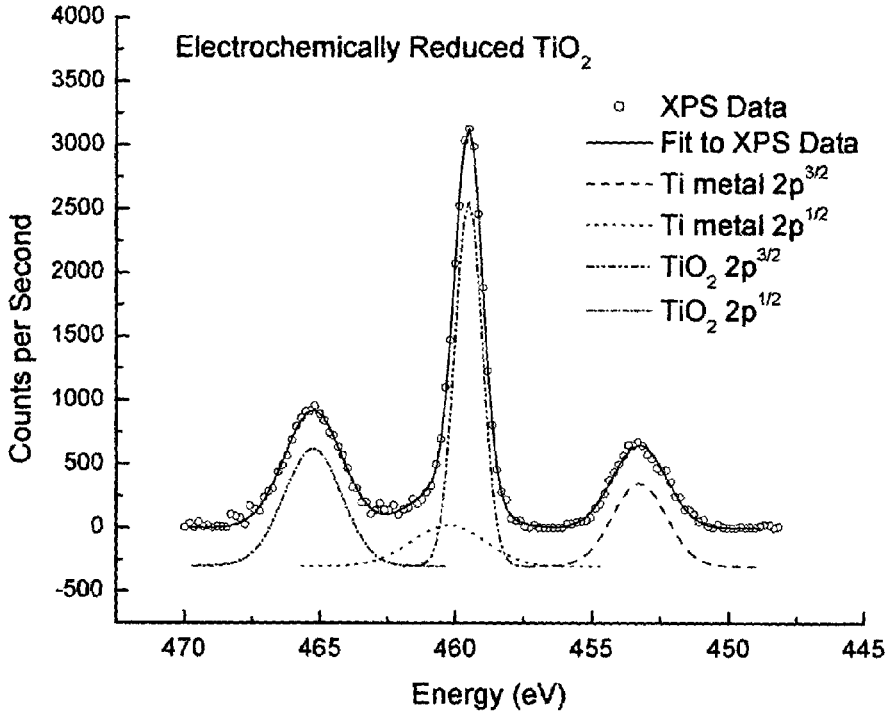

FIG. 3. shows XPS data for Ti, and $TiO_2$ recorded on the reduced bulk $TiO_2$ discussed below using the apparatus shown in FIG. 2.

Figure 4:
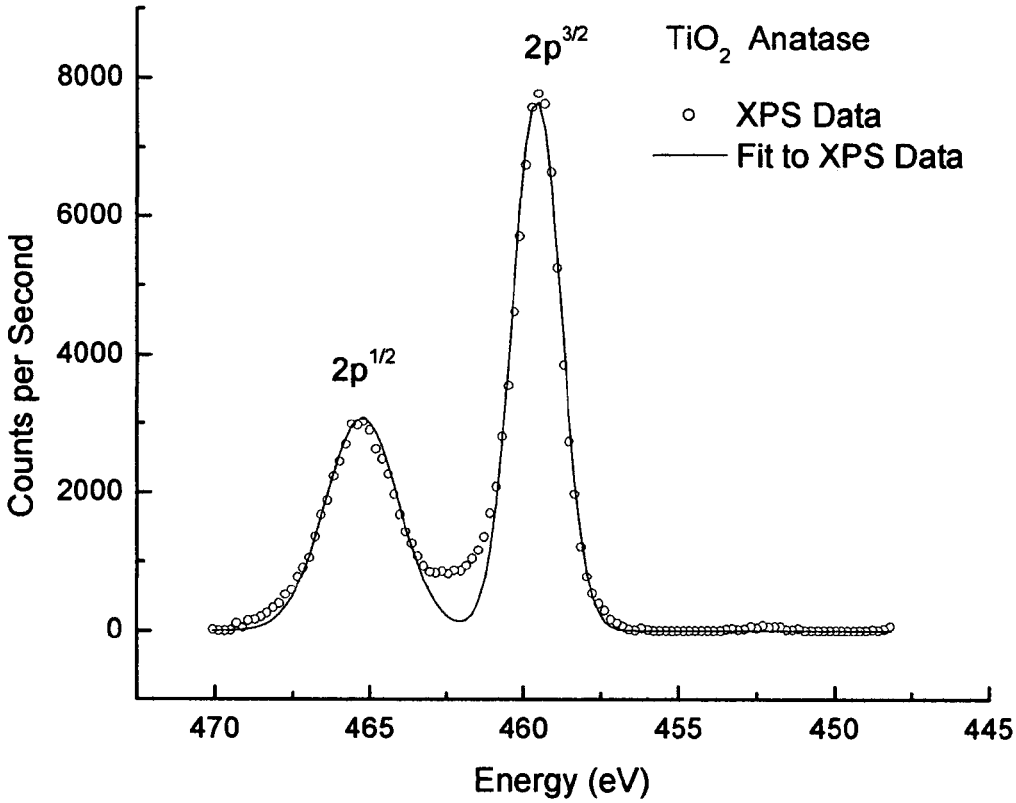

FIG. 4. shows XPS spectra of $TiO_2$ Anatase

DETAILED DESCRIPTION OF THE INVENTION

In this invention TiO2 has been reduced to Ti at room temperature using an electrochemical electrolysis system and a non-aqueous ionic solvent. To accomplish the reduction, or the removal of oxygen from $TiO_2$, current was passed through the system at a voltage predetermined to reduce the metal oxide. In this invention, a compound MX is reacted in an electrochemical system to remove X from MX. X may be an element chemically combined with M as for instance $TiO_2$, or dissolved in M. For instance O may react with M to form oxides, or it may also be dissolved as an impurity in M.

In this invention M is a metal or a semi-metal, while MX is a metal compound, or a semi-metal compound or a metal or semi-metal with X being dissolved in M.

The non-aqueous ionic liquid solvent electrolytes used in this invention are mono- and dialkylimidazolium salts mixed with aluminum chloride. This is a class of compounds is known as organochloroaluminates.

This class of compounds has been found to posses a wide electrochemically stable window, good electrical conductivity, high ionic mobility and a broad range of room temperature liquid compositions, negligible vapor pressure and excellent chemical and thermal stability. These compounds have described by Chauvin et al, *Chemtech,* 26–28 (1995), the reference being incorporated herein by reference in its entirety.

The non-aqueous ionic liquids used in the reactions of this invention described above were either 1-ethyl-3-methylimidazolium tetrafluoroborate or 1-ethyl-3-methylimidazolium chloride (EMIC) and aluminum chloride. The latter solvent was prepared by mixing $AlCl_3$ with EMIC in a 0.8 to 1.0 mole ratio. Non-aqueous ionic liquids have been studied and reported upon by C. L. Hussey in *Chemistry of Nonaqueous Solutions*, Mamantov and Popov, eds., VCH publishers, chapter 4 (1994), and McEwen et al. *Thermochemica Acta,* 357–358, 97–102 (2000). Both references are incorporated by reference in their entirety. The articles describe a plurality of non-aqueous ionic liquids based particularly on alkylimidazolium salts, which are useful in the instant invention. The temperature stability of these compounds makes them particularly attractive for this application because they are stable over a considerable range up to 200° C., and encompassing room temperature (20° C. to 25° C.). The preferred compounds for use as the ionic liquids are the dialkylimidazolium compounds. In addition, the substitution of alkyl groups for hydrogen atoms on carbon atoms in the ring increases the electrochemical and thermal stability of the resulting imidazolium compounds thus allowing for higher temperature use.

Metals and semi-metals represented by the symbol M comprise Ti, Si, Ge, Zr, Hf, Sm, U, Al, Mg, Nd, Mo, Cr, Li, La, Ce, Y, Sc, Be, V or Nb, or alloys thereof or mixtures thereof.

The Symbol X is representative of O, C, N, S, P, As, Sb, and halides. Phosphorus, arsenic, and antimony are impurities particularly associated with the semi-metals Ge, and Si whose purity is critical to the function as semi-conductors.

EXPERIMENTAL

To establish the efficacy of the invention described and claimed herein the following experiments were conducted. Titanium foil 10 cm long by 2 mm wide by 0.25 mm thick was oxidized in a furnace at 550° C. in air for 140 hours. A simple test tube type electrochemical cell as illustrated in FIG. 2. was used and experiments were carried out in a dry box. The cell contained a non-aqueous ionic liquid comprising aluminum chloride and 1-ethyl-3-methylmidazolium chloride (EMIC) in a mole ratio of 0.8:1.0 respectively giving a mole fraction of $AlCl_3$ of 0.44. A sample of the $TiO_2$ prepared above was placed in the cell so that ~1 cm was immersed in the electrolyte. The $TiO_2$ strip acts as the cathode, a platinum wire was used as the counter electrode or anode, and an aluminum wire was used as a reference electrode. Voltage was applied to the electrolysis cell and controlled by a Princeton Applied Research 283 potentiostat through a computer controlled interface. By controlling the voltage it was demonstrated that the oxide on the $TiO_2$ strip was removed in a short time at ambient temperature. FIG. 1. shows the voltammograms recorded at a sweep rate of 50 mV/sec for the oxidized Ti strip after it was introduced into the electrolyte. The initial sweep toward more negative voltages exhibits two clearly-defined reduction waves past −0.5 V. After several cycles, the resistivity of the oxide film decreases as the titanium oxide film is reduced to the metal. This is evidenced by a decrease in the overall slope of the current—voltage curve. Further, the anodic peak observed in the solid curve at −0.5 V is indicative of metal dissolution, the metal having been formed in the original cathodic sweep. For more extensive reduction, the voltage was held at −1.6 V. This value was chosen because that voltage lies beyond the reduction waves observed in the initial cycle in FIG. 1. The oxidized Ti strip was held at a voltage of −1.6V for 15 minutes, then the sweep was continued. The first full sweep after the 15 minute reaction is shown in FIG. 1. with the filled dotted line. The area between the solid line and the top of the filled dotted line is the charge used to reduce the thermally grown oxide on Ti. Further, the anodic peak at −0.5 V is now considerably larger and better defined than in the initial sweep. This indicates that a substantial amount of fresh titanium metal was available for the oxidation occurring in this peak.

In another experiment to determine if bulk $TiO_2$ could be reduced to Ti a basket was made of 40 mesh titanium gauze and then ~1 mm diameter particles of $TiO_2$ anatase obtained from Alfa Aesar were placed in the basket. The basket and particles were then placed in a fresh vial of EMIC-$AlCl_3$ electrolyte and the electrolysis was carried out again with the setup shown in FIG. 2. After 14 hours at an applied voltage of −1.8V, the sample basket was removed from the cell and the $TiO_2$ particles which were initially white were now dark gray. The particles were rinsed with benzene to remove the electrolyte, and the sample sealed in a vial and removed from the dry box in which the electrolysis experiments were carried out. When the titanium reaction particles were removed from the vial they were initially dark gray-almost black, but in time turned light gray with a blue cast.

X-ray photoelectron spectroscopy (XPS) was carried out on the isolated samples after reduction to determine if the titanium oxide had been reduced to titanium metal. The XPS data for the electrolyzed sample is shown in FIG. 3. The data show two sets of peaks, one for Ti and one for unreduced $TiO_2$. Analysis showed that ~12% of the Ti observed in the data is metallic titanium. In order to obtain good XPS data, the sample was washed with water and rinsed with isopropyl alcohol. The sample for analysis was prepared using a standard preparation technique. After grinding several of the particles of the reduced $TiO_2$ the resulting powder was pressed into a piece of indium foil and introduced into the XPS spectrometer where the data were recorded. The grinding processes further exposes the Ti metal to air which would produce more $TiO_2$. Hence the actual yield of titanium metal from the electroreduction of $TiO_2$ would be greater than the 12% found in the analysis. The reference spectrum for the initial sample of $TiO_2$ is shown in FIG. 4. This shows that there is no metallic titanium in the reference sample. This experiment was repeated using a platinum basket made from 50 mesh gauze. Following the reduction, the powder resulting from the grinding was pressed into a gold foil. The yield of Ti in this experiment was ~20%.

While the experiments above are demonstrations that MX can be transformed to M, as in $TiO_2$ to Ti metal, it should be clear that for any non-aqueous ionic liquid electrolyte having the proper stable electrochemical voltage window, that any MX can be converted to M.

Commercially, the electrochemical cell would consist of the MX cathode, the non-aqueous ionic electrolyte, and an anode selected and compatible with the voltage required for the reaction of converting MX to M.

What is claimed is:

1. A low temperature electrochemical method for removing specie X from compound MX, comprising the steps of A. forming an electrolysis system comprising an MX cathode, an anode, and a non-aqueous ionic liquid electrolyte;

B. passing a current through said system at a voltage determined to remove X from MX, as determined from the voltage v. current plot of MX; and C. isolating the reaction product resulting from removal of X from MX, as determined from the voltage v. current plot for MX.

2. The method according to claim 1, where M is selected from the group consisting of a metal, a metal compound, or a semi-metal compound.

3. The method according to claim 1, where M is selected from the group consisting of Ti, Si, Ge, Zr, Hf, Sm, U, Al, Mg, Nd, Mo, Cr, Li, La, Ce, Y, Sc, Be, V or Nb, or alloys thereof or mixtures thereof.

4. The method of claim 1 wherein X is selected from the group consisting of O, C, N, S, P, As, Sb, or a halide.

5. The method according to claim 1 wherein M is Ti (titanium) and X is O (oxygen).

6. The method according to claim 1 wherein the electrolyte is a chioroaluminate system based on nitrogen heterocyclic cations or functional equivalent thereof.

7. The method according to claim 1 wherein the electrolyte is selected from the group consisting of mono and dialkylimidazolium salts.

8. The method according to claim 1 wherein the electrolyte is selected from the group consisting of mono and dialkylimidazolium salts.

9. The method according to claim 1 wherein the electrolyte is 1-ethyl-3-methylimidazolium tetrafluoroborate.

10. A low temperature electrochemical method for removing O from $TiO_2$, comprising the steps of:

A. forming an electrolysis system comprising a $TiO_2$ cathode, an anode, and a non-aqueous ionic liquid electrolyte;

B. passing a current through said system at a voltage selected to remove O from said $TiO_2$; and C. isolating the reaction product resulting from the removal of O from $TiO_2$.

* * * * *

UNITED STATES PATENT AND TRADEMARK OFFICE

CERTIFICATE OF CORRECTION

PATENT NO. : 6,958,115 B2
APPLICATION NO. : 10/602056
DATED : October 25, 2005
INVENTOR(S) : William E O'Grady et al.

It is certified that error appears in the above-identified patent and that said Letters Patent is hereby corrected as shown below:

On the title page item (75), Replace Inventor "William E. O'Gardy" with --William E. O'Grady--.

On the title page item (75), Replace Inventor "Graham T. Cheeck" with --Graham T. Cheek--.

Signed and Sealed this

Third Day of October, 2006

JON W. DUDAS
*Director of the United States Patent and Trademark Office*